United States Patent [19]

Markwardt

[11] Patent Number: 4,878,806

[45] Date of Patent: Nov. 7, 1989

[54] DUAL MOUNTING CEILING FAN

[75] Inventor: Herbert W. Markwardt, Fort Worth, Tex.

[73] Assignee: Encon Industries, Inc., Fort Worth, Tex.

[21] Appl. No.: 164,098

[22] Filed: Mar. 4, 1988

Related U.S. Application Data

[63] Continuation-in-part of Ser. No. 913,475, Mar. 8, 1988, Pat. No. 4,729,725.

[51] Int. Cl.[4] ..... F04D 29/64

[52] U.S. Cl. ..... 416/5; 416/170 R

[58] Field of Search ..... 416/5, 246, 170 C, 170 R, 416/244 R

[56] References Cited

U.S. PATENT DOCUMENTS

| | | | |
|---|---|---|---|
| 4,073,598 | 2/1978 | Mizutani et al. | 416/5 |
| 4,342,073 | 7/1982 | Ranten | 416/5 X |
| 4,592,702 | 6/1986 | Bogage | 416/5 X |
| 4,621,977 | 11/1986 | Markwardt | 416/5 |
| 4,634,345 | 1/1987 | Stanek et al. | 416/170 C X |
| 4,640,668 | 2/1987 | Yang | 416/5 X |
| 4,692,096 | 9/1987 | Yang | 416/5 X |
| 4,720,241 | 1/1988 | Markwardt | 416/5 |
| 4,729,725 | 3/1988 | Markwardt | 416/244 R |

FOREIGN PATENT DOCUMENTS

| | | | |
|---|---|---|---|
| 101292 | 6/1983 | Japan | 416/5 |
| 385772 | 1/1933 | United Kingdom | 416/5 |
| 478417 | 1/1938 | United Kingdom | 416/5 |
| 1584264 | 2/1981 | United Kingdom | 416/5 |
| 1590186 | 5/1981 | United Kingdom | 416/5 |
| 2149013 | 6/1985 | United Kingdom | 416/5 |

*Primary Examiner*—Everette A. Powell, Jr.
*Attorney, Agent, or Firm*—James E. Bradley

[57] ABSTRACT

A ceiling fan optionally usable in a suspended down rod mode in which the fan blades are spaced downwardly from the ceiling, or in a flush mounted mode in which the blades are relatively close to the ceiling. The fan includes a canopy secured adjacent the ceiling, and an optionally downrod which swivelly supports the fan housing and blades at a position spaced downwardly from the ceiling. The fan further includes a motor housing which has top and bottom housing plates and an annular band located between the housing plates. The top and bottom plates are secured to a soft iron armature which is driven in rotation by a stator carried on a rod extended through the center of the fan housing. The fan blades are connected to the bottom plate of the housing, and housing and blades are driven in rotation with the iron armature. A flush mounting disc is secured around the rod which projects through the center of the fan housing and carries the stator, and this disc is adapted for securement to the canopy after the downrod has been removed from the assembly.

3 Claims, 3 Drawing Sheets

DUAL MOUNTING CEILING FAN

Related Applications

This application is a continuation-in-part of U.S. patent application Ser. No. 913,475 issued to U.S. Pat. No. 4,729,725 on Mar. 8, 1988 and entitled MOUNTING SYSTEM FOR SELECTIVELY MOUNTING CEILING FANS.

Field of the Invention

The invention relates to dual mounting ceiling fans which can optionally be mounted in a down rod mode in which the blades are spaced downwardly from the ceiling a selected distance for optimum air circulation, or can be flush mounted on the ceiling with the fan blades located relatively closely adjacent the ceiling. The invention further relates to electrically powered ceiling fans of the type in which the fan motor housing and fan blades are interconnected, and are concurrently driven in rotation.

BACKGROUND OF THE INVENTION

Brief Description of the Prior Art

Electrically powered ceiling fans are widely utilized as a method of environmental comfort control within dwellings and in business establishments, and in such usage, are mounted from room ceilings which greatly vary in their height above the floor. Because of this variation, some ceiling fans, as manufactured and installed by the consumer, are suspended from the ceiling in a position such that the rotating fan blades are dangerously close to the heads of tall persons standing in the room. In other rooms having relatively high ceilings, there is little danger of injurious contact with the fan blades, and for this reason, it is always desirable to mount the blades at a location spaced sufficiently below the ceiling that optimum circulation of air is obtained by the rotation of the blades.

Because of the variable vertical dimensions of the spaces within which ceiling fans are used, it is desirable to provide a structure which can be quickly altered so as to permit the fan to be either mounted in a flush mount mode, where the blades are close to the ceiling, or in a suspended down rod mode, where the rotating blades are an optimum distance from the ceiling in terms of the air circulation which is effected.

One such construction providing an easily used option for mounting a ceiling fan in a flush mode, in which the blades are closely adjacent the ceiling, or in a down rod mode of the type described, is the fan construction disclosed in U.S. patent application Ser. No. 913,475, U.S. Pat. No. 4,729,725. In converting from a down rod mounting arrangement to a flush mounting arrangement, the down rod of the fan is eliminated, and the canopy which is used to suspend the fan from the ceiling is secured directly to the upper side of the fan housing so that the fan blades are thereby shifted to a location relatively close to the ceiling. When the down rod mode is used, the down rod is extended through an opening in the center of the canopy, and the fan motor housing and blades are then secured to the lower end of the down rod, and as such, are spaced an optimum distance downwardly from the ceiling.

Although the described structure facilitating the optional mounting of the ceiling fan in either a flush mount mode or a down rod mode can be easily utilized with a fan of the type illustrated and described in such application, in which the housing for the fan motor is stationary and can be secured directly to the canopy after removal of the down rod, this structure is inadequate to permit a very popular type of ceiling fan now being marketed to be flush mounted in the manner described. This is a ceiling fan in which the blades are secured to the fan motor housing, and both the motor housing and blades are then caused to rotate about a central axis when the fan is operated. This type of fan offers certain advantages over other types currently marketed, and it would be desirable if such a fan could be flush mounted quickly and easily as an optional mode of mounting alternative to the down rod mode of mounting.

BRIEF DESCRIPTION OF THE PRESENT INVENTION

The present invention provides a dual mounting ceiling fan which is optionally usable in a suspended, down rod mode, in which the blades of the fan are spaced downwardly from the ceiling, or in a flush mounted mode, in which the blades are relatively close to the ceiling.

The dual mounting ceiling fan includes a canopy which can be secured adjacent the ceiling, and an optional down rod carrying a swivel ball at the upper end thereof, and detachably connectable at its lower end to a pedestal carried at the upper side of the fan housing. The fan further includes a motor housing which has top and bottom housing plates, and an annular band located between the housing plates. The top and bottom housing plates are connected to a soft iron armature of the fan motor so that the fan motor housing and armature are driven in rotation by a stator carried on a rod extended through the center of the fan housing. The fan blades are connected to the bottom plate of the motor housing so that both the blades and the motor housing are driven in rotation, together with the iron armature to which the housing is secured, as the fan is operated. A flush mounting disc extends around and is connected to the rod which projects through the center of the fan housing and which carries the stator. This flush mounting disc is adapted for securement to the canopy after the down rod has been removed from the assembly. The fan motor housing and the fan blades are thus mounted closely adjacent the canopy, and are therefore located closely adjacent the ceiling to thereby achieve the flush mounting of the fan in this alternate mode of usage.

An important object of the invention is to provide a dual mounting ceiling fan in which the motor housing and the blades secured to the housing are concurrently driven in rotation, which fan can be mounted closely adjacent the ceiling where additional height of blade location above the floor is necessary, or can be suspended at the lower end of the down rod so as to position the fan motor housing, and the blades carried thereon, at a location which is optimum in its spacing from the ceiling, insofar as air circulation by the rotating fan blades is concerned.

Another object of the invention is to provide a convertible dual mounting ceiling fan assembly which can be quickly used to mount an electrically powered ceiling fan in a flush mounted mode, or, alternatively, in a down rod suspended mode where the fan motor housing and the fan blades are spaced downwardly from the ceiling at an optimum distance.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
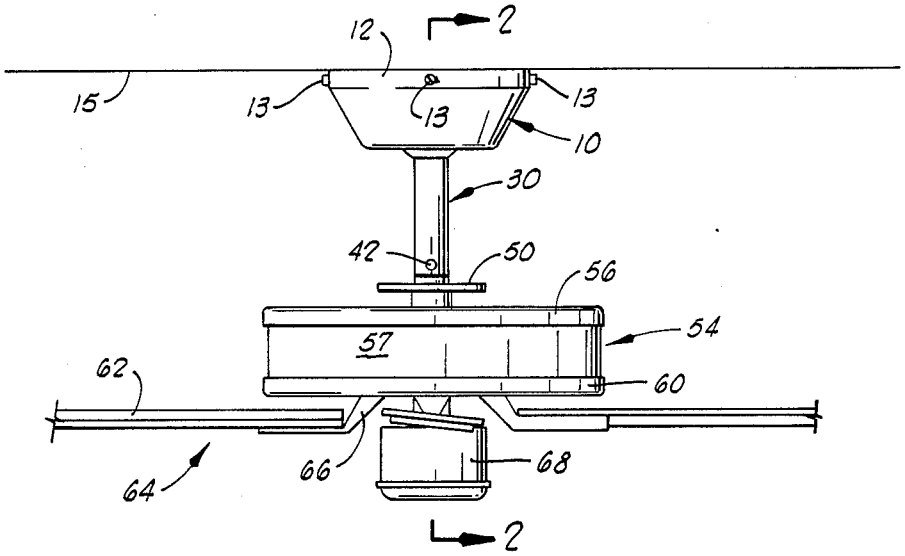
FIG. 1 is a side elevation view of the dual mount fan assembly constructed in accordance with the present invention and showing the fan in a down rod mode of mounting.
Figure 2:
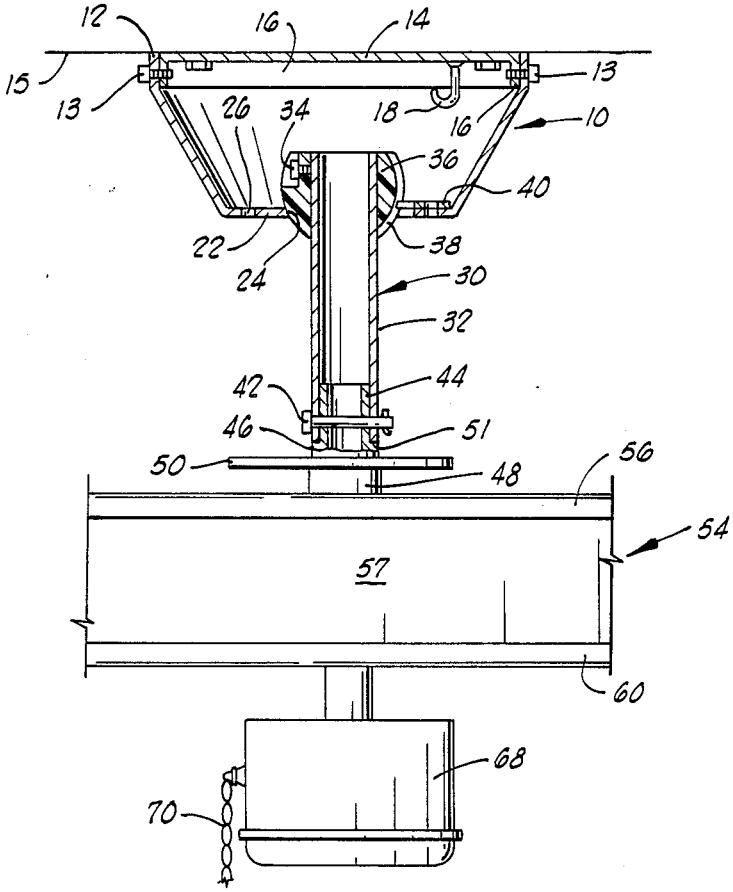
FIG. 2 is a view partially in section and partially in elevation, with parts broken away, showing certain details of structure of the fan of the present invention.

In the drawings, FIGS. 1 and 2 illustrate the dual mounting ceiling fan of the invention as the same appears when mounted in a down rod mode. The fan is of the type in which the housing of the fan motor, and the fan blades which are attached to this housing, rotate concurrently during operation of the fan. In the down rod mode, the motor housing and attached fan blades are spaced downwardly from the ceiling to which the ceiling fan is mounted.

Figure 3:
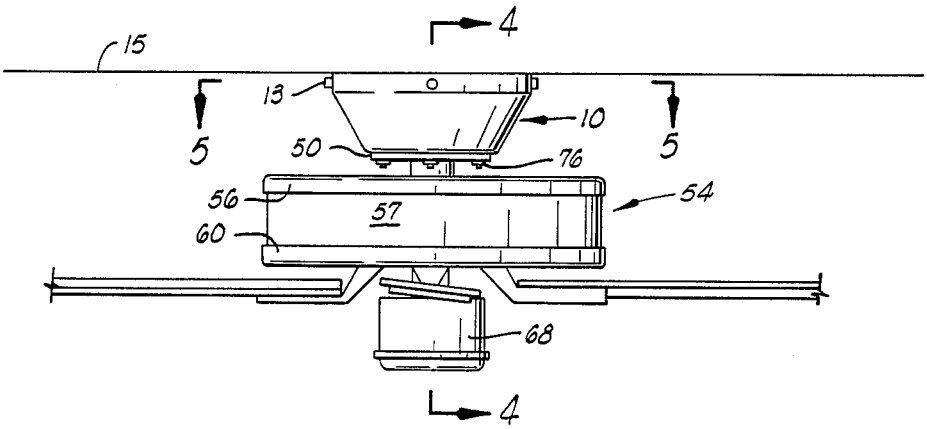
FIG. 3 is a side elevation view of the fan of the invention showing the fan mounted in a flush mount mode, as contrasted with the suspended down rod mode of mounting shown in FIG. 1.
Figure 4:
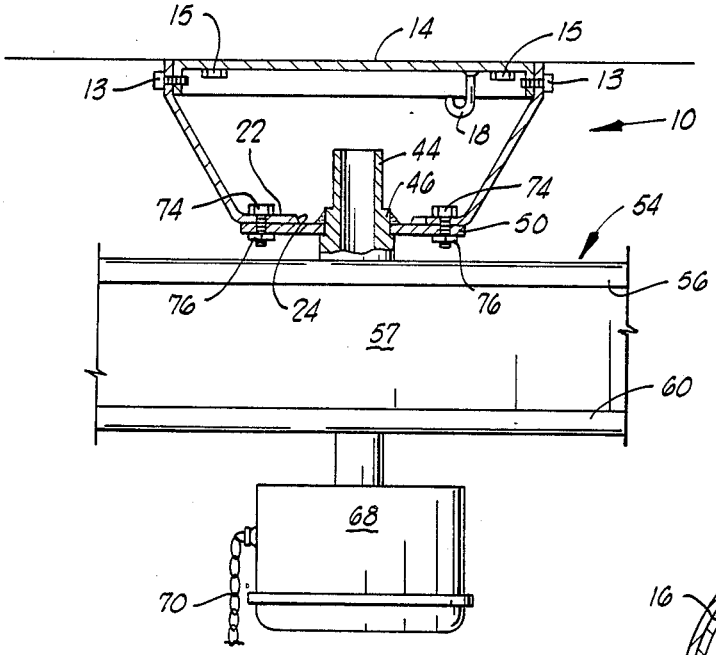
FIG. 4 is a view similar to FIG. 2, illustrating a part of the fan in section and a part in side elevation, but showing the appearance of the fan in the flush mount mode.
Figure 5:
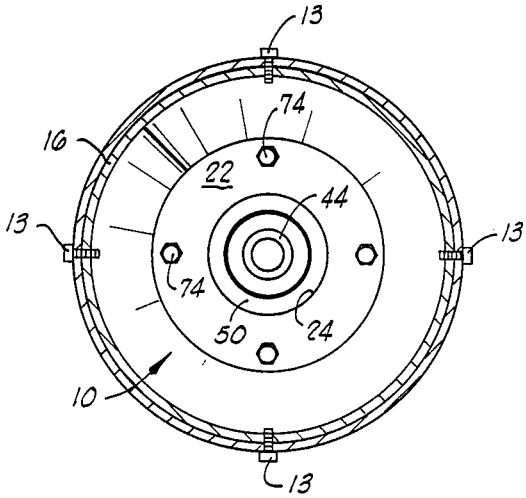
FIG. 5 is a top plan view of the fan.

FIGS. 3–5 show the fan in the flush mount mode of installation in which the housing for the fan motor and the fan blades are positioned relatively close to the ceiling to which the fan is mounted.

Referring initially to the down rod mounting installation shown in FIGS. 1 and 2, the dual mount fan includes a canopy 10 which is of inverted bell-shape configuration. The canopy 10 includes an outer peripheral annular flange 12 disposed at its upper end. The flange 12 is secured by suitable screws 13 to a mounting plate 14 which carries a peripheral annular downwardly extending flange 16. The mounting plate 14 is suitably mounted immediately beneath a ceiling 15 and carries a downwardly extending J-hook 18 for a purpose hereinafter described.

As shown in FIG. 2, the canopy 10 further includes a downwardly facing, horizontally extending bottom plate 22, which bottom plate defines a relatively large central opening 24. The bottom plate 22 further includes four, spaced screw or bolt holes 26 which are spaced around the large central opening 24, and are used for mounting the fan in the flush mount mode of installation as hereinafter described. The location of these screw or bolt holes 26 is best perceived by reference to FIG. 5 of the drawings which shows the heads of four bolts, projected through these holes.

In order to mount the ceiling fan in a down rod installation status, the lower end of a down rod subassembly, designated generally by reference numeral 30, is projected through the central opening 24 formed through the horizontally extending bottom plate 22. The down rod subassembly 30 includes a relatively light weight, hollow or tubular elongated down rod 32. The down rod 32 has fixed to its upper end by means of a set screw 34, or other suitable fastener device, a semi-spherical ball 36 which is seated in the aperture 24 so that it can oscillate to a slight degree, and as needed to accommodate any vibratory or oscillatory movements of the fan housing and rotating blades suspended on the lower end of the tubular down rod 32. The ball 36 can be suitably made of plastic, as shown, or of metal, or of any other suitable material. In the illustrated embodiment, a groove 38 is cut into one side of the ball 36, and a key 40, carried on the upper side of the horizontal bottom plate 22, extends into the groove 38 and functions as anti-rotation means to prevent rotation of the ball 36 and the tubular down rod 32 about the longitudinal axis of the down rod.

At its lower end, the tubular down rod 32 is secured by means of a pin 42 to the upwardly projecting down rod sleeve or neck 44 on the upper end of a generally cylindrical collar or hub 46 formed at the upper end of a central rod or shaft hereinafter described. A centrally apertured flush mounting flush mounting plate or disc 50 is secured to the collar or hub 46 by welding or other suitable means, and defines near its outer periphery, four circumferentially spaced holes or apertures 49 (see FIG. 6) which are spaced and positioned for alignment with the bolt holes 26 in the plate 22 of the canopy 10. In referring to FIG. 2 of the drawings, it will be noted that the neck 44 has an outer diameter selected to permit the neck to be telescoped in a close fit into the tubular down rod 32. The down rod 32 thus receives the neck 44 with its lower end portion, and the lower end of the down rod abuts a shoulder 51 formed at the intersection between the collar 46 and the neck 44.

Figure 6:
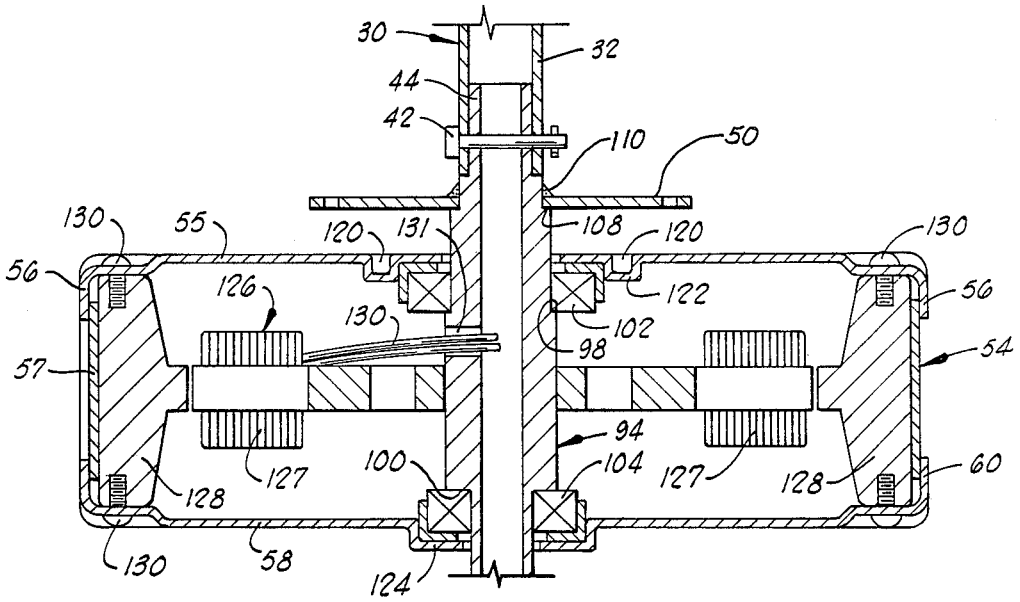
FIG. 6 is a vertical sectional view through the center of the fan motor housing utilized in one embodiment of the present invention and showing the manner in which the flush mounting plate or disc is secured to an axially extending rod which projects through the center of the fan motor housing.

The ceiling fan includes a ceiling fan motor housing 54 constructed similarly to that which is described in U.S. Pat. Nos. 4,621,977 and 4,720,241 and shown in U.S. Design Patent DES.-285,720, all assigned to the assignee of the present invention. Thus, the housing includes a horizontally extending, centrally apertured housing top plate 55 which carries a circular outer peripheral edge, and has an upwardly facing surface over which the flush mounting disc 50 is located as shown in FIG. 6. The housing top plate 55 is provided with a plurality of circumferentially spaced ventilation holes (not shown) which are located radially outwardly from the center of the top plate. In addition, the top plate carries an annular, downwardly extending peripheral flange 56, which, in one form or embodiment of the invention, acts as a retention element for retaining, in cooperation with a similar and corresponding flange on a bottom plate 58 of the housing, an annular side band 57. The horizontally extending, centrally apertured bottom plate 58 is provided at a downwardly spaced location with respect to the top plate 55 and the bottom plate 58 carries an annular, peripheral, upwardly extending flange 60. The flange 60 cooperates, as previously described, with the flange 56 to retain the annular side band 57 in the illustrated position.

Secured to the lower side of the motor housing subassembly 54 are a plurality of fan blade subassemblies 64, as shown in FIG. 1. Each of the fan blade subassemblies 64 includes a fan blade 62 and a bracket 66 by which the fan blade is connected directly to the lower housing plate 58 of the fan motor housing 54. From this description, it will be perceived that the blades 62 are secured to the fan motor housing for rotation therewith. At its lower end, a central, hollow rod projected through the center of the fan motor housing, and hereinafter described, carries a switch housing 68 by means of which the motor is energized when a pull chain 70 is pulled to close the switch in the electrical circuit to the fan motor.

In FIG. 6 of the drawings, the internal construction of the fan motor housing subassembly 54 is illustrated, and the way in which the flush mounting disc or plate 50 is secured to a central, axially extending hollow rod or shaft 94 is also further illustrated. As shown in FIG. 6, the central, axially extending shaft 94 includes an enlarged central portion 96 which results in the formation of a pair of shoulders 98 and 100 against which an upper bearing 102 and a lower bearing 104 are positioned. The central, axially extending shaft 94 is further characterized in having the hub portion 46 of reduced diameter at its upper end, which hub portion forms a shoulder 108. The shoulder 108 acts as a seat against which the flush mounting disc or plate 50 is mounted, and is secured at this location by welding 110 or other suitable means. Above the hub portion 46, the projecting tubular neck 44, of yet further reduced diameter, is provided on the outer end of the central, axially extending hollow shaft 94. The reduced diameter neck 44 is provided with aligned apertures therethrough to permit the pin 42 to be received as has been previously described herein.

In the illustrated embodiment of the invention, the fan motor housing subassembly 54 includes the housing top plate 55, a housing bottom plate 58, and the annular, axially extending side band 57 which fills the space between the housing top plate and the housing bottom plate at the outer periphery of the fan motor housing subassembly 54.

In the illustrated embodiment, the housing top plate 55 and the housing bottom plate 58 are each shaped to provide recesses or seats for the upper bearing 102 and the lower bearing 104, respectively. In the case of the housing top plate 55, the seat for the top bearing 102 is formed by an annular indentation 120 which forms a downwardly extending internal rib 122 for receiving the top bearing 102 in the thus defined recess cavity. In the case of the housing bottom plate 58, the housing bottom plate defines a protuberant portion 124 into which the lower bearing 104 is seated. In this way, the fan motor housing subassembly 54 is mounted upon the central, axially extending shaft 94 for rotation about the central axis thereof, and in undergoing such rotation carries with it the fan blades.

As is explained in greater detail in U.S. Pat. Nos. 4,621,977 and 4,720,241, a stator 126 is keyed to, and mounted upon, the enlarged central portion 96 of the central, axially extending shaft or rod 94. The stator 126 includes a plurality of copper windings 127 which are supplied with electrical current delivered by conductors 130 which project through a radial opening 131 in the hollow shaft 94. A soft iron rotor or armature 128 of annular configuration is provided within the motor fan housing subassembly 54 and just inside the annular side band 57. The soft iron armature 128 is secured to the housing top plate 55 by means of a plurality of screws 130 and is secured to the housing bottom plate 58 by means of screws 132. Thus, as explained in U.S. Pat. Nos. 4,621,977 and 4,720,241, when the fan is energized, the soft iron armature 128 and the housing top plate 55 and housing bottom plate 58, are caused to undergo rotation about the stator 126. The fan blades (not shown) are secured to the housing lower plate 58, and, of course, also undergo rotation.

In assembling the electrically powered ceiling fan in a down rod installation mode, the down rod subassembly 30 is first mounted within the canopy 10 in the manner illustrated in FIG. 2 so that the ball 36 thereof is swivelly supported within the circular central opening 24 formed in the plate 22. The assembly of the fan further includes the mounting of the motor housing, motor contained therein, fan blades attached to the motor housing and switch box, all on the lower end of the down rod 32 by means of the transverse pin 42. With the fan thus assembled, the canopy 10 is hung on the J-hook 18 by extending the point of the J-hook through one of the holes in the flange 12 of the canopy 10 which is used for receiving the screws 13. This frees the hands of the installer to make the necessary electrical connections to electrical leads projected through the mounting plate 14 and toward the interior of the canopy 10. After the electrical connections have been effected, the canopy 10 is lifted off the J-hook and secured to the mounting plate 14 by means of a plurality of the screws 13 extended through registering holes through the flange 12 of the canopy and the downwardly extending annular flange 16 of the mounting plate. Installation is then complete and the fan can be operated in the down rod mode which causes relatively efficient movement of air by spacing the fan blades subassemblies 64 downwardly an optimum distance from the ceiling.

In FIG. 3, the dual mount fan of the invention is illustrated mounted in the flush mounted mode. It will be perceived, by referring to FIGS. 3 and 4, that in this way of mounting the fan, the down rod subassembly 30 has been removed, and that the neck 44 and collar or hub 46 have been extended upwardly into the interior of the canopy 10 through the opening 24 formed in the lower plate 22 thereof. In this position, the flush mounting disc 50 bears flatly against the plate 22 and the screw holes 49 therethrough are aligned with the screw holes 26 formed through the plate 22 of the canopy 10. Suitable screws 74 are then extended through these registering screw holes and engaged with nuts 76 which are positioned on the other side of the flush mounting disc 50 as shown in FIG. 4.

The fan is then electrically wired, as previously described, by hanging the canopy 10, and the fan suspended therefrom, from the J-hook 18 projecting downwardly from the mounting plate 14. After the electrical connections have been completed, the canopy 10 is secured in place around the mounting plate 14 by means of the screws 13. In the flush mounted mode, the blades of the fan are supported relatively close to the ceiling so as to afford more clearance above the floor in an enclosure where the ceiling is relatively low. The fan motor housing 54 and the blades 64 mounted thereon still rotate about the longitudinal axis of the mounting shaft or rod projected through the center of the fan motor housing and supporting the housing on the bearings which are mounted within recesses in the top plate and bottom plate.

Figure 7:
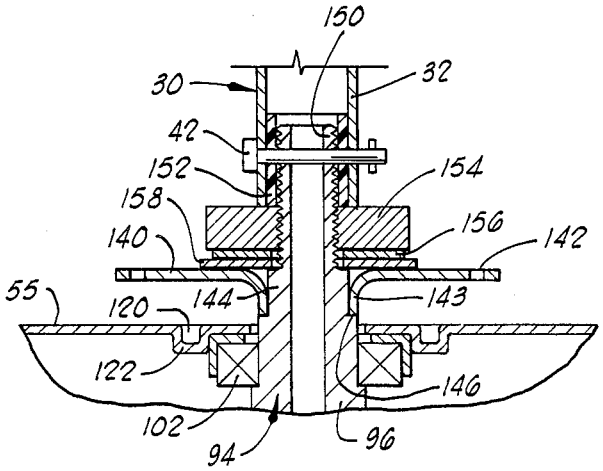
FIG. 7 is a vertical sectional view through the center of a hollow down rod and a centrally disposed, axially extending rod upon which the fan housing is mounted, and showing an alternate construction by which the flush mounting plate used in an alternate embodiment of the invention is secured to the central axially extending rod at a location below the down rod.

In FIG. 7 of the drawings, a portion of a different embodiment of the invention is illustrated. Some common elements are included in this different embodiment, however, which are also present in the embodiment shown in FIGS. 1–6, and where such is the case, identical reference numerals have been used. Thus, the fan motor housing top plate 55 is the same as in the embodiment illustrated in FIG. 6, as is the top bearing 102 and the enlarged central portion 96 of the central, axially extending hollow shaft or rod 94.

The type of flush mounting disc or plate 140 utilized in the embodiment of FIG. 7 is different from that which is shown in FIGS. 1–6. Here the flush mounting disc or plate 140 defines screw apertures 142 and carries a central annular sleeve portion 143 which surrounds a hub 144 of reduced diameter formed on the central, axially extending shaft 94. The sleeve portion 143 of the flush mounting disc 140 bears against a shoulder 146 formed adjacent the hub portion of the shaft 94.

At its upper end, the central shaft or rod 94 carries a threaded neck 150 which is externally threaded and is surrounded by a rubber sleeve 152. The sleeve and neck are inserted into the lower end of the down rod 32 in the down rod mode of mounting. A nut 154 is threaded onto the neck 150 so as to press washers 156 and 158 against flush mounting disc 140 and force the sleeve portion 143 down against the shoulder. This pressure then locks the flush mounting disc to the shaft 92 for rotation therewith. For flush mounting, the down rod 32 is again removed and the disc 140 is again bolted to the canopy.

Although a preferred embodiment of the invention has been herein described, it will be understood that various changes can be made in the illustrated and described embodiment without departure from the basic principles which underlie the invention. Changes and innovations of this type are deemed to be circumscribed by the spirit and scope of the invention except as the same may be necessarily limited by the appended claims, or reasonable equivalents thereof.

What is claimed is:

1. A ceiling fan adapted for selective mounting flush to the ceiling in a flush mounting mode, or alternatively, suspended by a down rod in a down rod mounting mode, comprising:

a horizontally extending ceiling mounting plate having a downwardly extending flange, said flange defining a plurality of screw holes therethrough;

a concavo-convex canopy having screw holes therethrough and including a centrally apertured lower central plate, said lower central plate having a plurality of upper fastener holes formed therethrough in spaced array about the aperture through the center of said central plate;

a plurality of mounting screws extending through said screw holes in the canopy and into engagement with the screw holes in the downwardly extending flange of the ceiling mounting plate;

a J-hook projecting down from the ceiling mounting plate from a location within the downwardly extending flange and having a canopy-suspending point thereon of a size to pass through the screw holes in the canopy and facilitating hanging of the canopy therefrom to effect electrical connections to the fan;

a down rod assembly removably connected to the canopy and projecting downwardly therefrom, said down rod assembly including:

an elongated tubular down rod having an upper end extending through the central aperture in said lower central plate and having a lower end;

a ball element secured to the upper end of said down rod and adapted to land on the lower central plate for swivelly supporting said down rod suspended from said canopy when said fan is mounted in said down rod mounting mode;

anti-rotation means on the ball element and the central plate for preventing rotation of the ball element relative to the canopy; and a down rod sleeve telescopingly receiving the lower end of said down rod and sized to project through the aperture in the lower central plate of said canopy when said fan is mounted in said flush mounting mode;

a fan motor housing carried by said down rod sleeve;

a flush mounting plate carried with the fan motor housing and having a plurality of lower fastener holes therethrough vertically aligned with said upper fastener holes in said central plate of said canopy; and means for interengaging said lower central plate of said canopy in flat abutting contact with said flush mounting plate with said down rod sleeve projecting into said canopy through the central aperture in said lower central plate at a time when the down rod and ball element are removed to facilitate flush mounting of the fan, said interengaging means comprising a plurality of fasteners removably carried in said lower fastener holes through said flush mounting plate, and sized to pass through the upper fastener holes in said central plate of said canopy.

2. A ceiling fan adapted for selective mounting flush to the ceiling in a flush mounting mode, or alternatively, suspended upon a down rod in a down rod mounting mode, comprising in combination;

a horizontally extending ceiling mounting plate having a downwardly extending flange, said flange defining a plurality of screw holes therethrough;

a concavo-convex canopy having screw holes therethrough and including a centrally apertured lower central plate, said lower central plate having a plurality of upper fastener holes formed therethrough in spaced array about the aperture through the center of said central plate;

a plurality of mounting screws extending through said screw holes in the canopy and into engagement with the screw holes in the downwardly extending flange of the ceiling mounting plate;

a J-hook projecting down from the ceiling mounting plate from a location within the downwardly extending flange and having a canopy-suspending point thereon of a size to pass through the screw holes in the canopy and facilitating hanging of the canopy therefrom to effect electrical connections to the fan;

a down rod assembly removably connected to the canopy and projecting downwardly therefrom, said down rod assembly including:

an elongated tubular down rod having an upper end extending through the central aperture in said lower central plate and having a lower end;

a ball element secured to the upper end of said down rod and adapted to land on the lower central plate for swivelly supporting said down rod suspended from said canopy when said fan is mounted in said down rod mounting mode;

anti-rotation means on the ball element and the central plate for preventing rotation of the ball element relative to the canopy; and a down rod sleeve telescopingly receiving the lower end of said down rod and sized to project through the aperture in the lower central plate of said canopy when said fan is mounted in said flush mounting mode;

a fan motor housing carried by said down rod sleeve;

a flush mounting plate carried with the fan motor housing by the down rod sleeve, the fan motor housing being rotatable relative to the flush mounting plate and spaced below the flush mounting plate, the flush mounting plate having a plurality of lower fastener holes therethrough vertically aligned with said upper fastener holes in said central plate of said canopy; and means for interengaging said lower central plate of said canopy in flat abutting contact with said flush mounting plate with said down rod sleeve projecting into said canopy through the central aperture in said lower central plate at a time when the down rod and ball element are removed to facilitate flush mounting of the fan, said interengaging means comprising a plurality of fasteners removably carried in said lower fastener holes through said flush mounting plate, and sized to pass through the upper fastener holes in said central plate of said canopy.

3. A ceiling fan adapted for selective mounting flush to the ceiling in a flush mounting mode, or alternatively, suspended upon a down rod in a down rod mounting mode, comprising in combination;

a horizontally extending ceiling mounting plate having a downwardly extending flange, said flange defining a plurality of screw holes therethrough;

a cancavo-convex canopy having screw holes therethrough and including a centrally apertured lower central plate, said lower central plate having a plurality of upper fastener holes formed therethrough in spaced array about the aperture through the center of said central plate;

a plurality of mounting screws extending through said screw holes in the canopy and into engagement with the screw holes in the downwardly extending flange of the ceiling mounting plate;

a J-hook projecting down from the ceiling mounting plate from a location within the downwardly extending flange and having a canopy-suspending point thereon of a size to pass through the screw holes in the canopy and facilitating hanging of the canopy therefrom to effect electrical connections to the fan;

a down rod assembly removably connected to the canopy and projecting downwardly therefrom, said down rod assembly including:

an elongated tubular down rod having an upper end extending through the central aperture in said lower central plate and having a lower end;

a ball element secured to the upper end of said down rod and adapted to land on the lower central plate for swivelly supporting said down rod suspended from said canopy when said fan is mounted in said down rod mounting mode;

anti-rotation means on the ball element and the central plate for preventing rotation of the ball element relative to the canopy; and a down rod sleeve telescopingly receiving the lower end of said down rod and sized to project through the aperture in the lower central plate of said canopy when said fan is mounted in said flush mounting mode;

a fan motor housing;

bearing means supporting said fan motor housing on said down rod sleeve for rotation of said housing about said rod means;

a flush mounting plate carried with the fan motor housing by the down rod sleeve, the fan motor housing being rotatable relative to the flush mounting plate and spaced below the flush mounting plate, the flush mounting plate having a plurality of lower fastener holes therethrough vertically aligned with said upper fastener holes in said central plate of said canopy; and means for interengaging said lower central plate of said canopy in flat abutting contact with said flush mounting plate with said down rod sleeve projecting into said canopy through the central aperture in said lower central plate at a time when the down rod and ball element are removed to facilitate flush mounting of the fan, said interengaging means comprising a plurality of fasteners removably carried in said lower fastener holes through said flush mounting plate, and sized to pass through the upper fastener holes in said central plate of said canopy.

* * * * *